US005983053A

United States Patent [19]

Mordenga et al.

[11] Patent Number: 5,983,053

[45] Date of Patent: Nov. 9, 1999

[54] NON-CONTACTING HYBRID JUMPING DEVELOPER DIRT EMISSION BAFFLE SEAL

[75] Inventors: Samuel P. Mordenga, Rochester; Thomas J. Behe, Webster; Thomas C. Keyes, Fairport; Dan F. Lockwood, Ontario; William B. Lindsey, Rochester; Michael J. Palencar, Webster, all of N.Y.

[73] Assignee: Xerox Corporation, Stamford, Conn.

[21] Appl. No.: 09/058,615

[22] Filed: Apr. 10, 1998

Related U.S. Application Data

[60] Provisional application No. 60/043,493, Apr. 11, 1997.

[51] Int. Cl.[6] ..... G03G 15/08

[52] U.S. Cl. ..... 399/103

[58] Field of Search ..... 399/98, 102, 103

[56] References Cited

U.S. PATENT DOCUMENTS 5,267,007 11/1993 Watanabe et al. ..... 399/104

*Primary Examiner*—Arthur T. Grimley
*Assistant Examiner*—George Edward Wendal, Jr.
*Attorney, Agent, or Firm*—Kevin R. Kepner

[57] ABSTRACT

A noncontact seal for a donor roll in an electrophotographic printing machine. The seal is fixed in the developer housing and envelopes each end of the donor roll but does not contact the donor roll. The small space does not allow a positive airflow sufficient to cause toner particles to be emited from the developer housing so as to contaminate the other portions of the printing machine. The seal is made of a low friction material such as DELRIN® so that toner particles do not stick to the seal and cause a buildup that would be detrimental to the photoreceptive member.

4 Claims, 3 Drawing Sheets

NON-CONTACTING HYBRID JUMPING DEVELOPER DIRT EMISSION BAFFLE SEAL

Priority is claimed from previously-filed Provisional Patent Application filed Apr. 11, 1997, as U.S. application Ser. No. 60/043,493 by Samuel P. Mordenga, et al, entitled "Noncontacting Hybrid Jumping Developer Dirt Emission Baffle Seal", Attorney Docket No. D/97045P.

This invention relates generally to a device to prevent toner particles from contaminating the interior of an electrophotographic printing machine, and more particularly concerns a seal for a developer housing in a hybrid jumping developer system.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a machine of the foregoing type, utilizing a hybrid jumping development (HJD) system, the development roll, better known as the donor roll, is powered by two development fields (potentials across an air gap). The first field is the ac jumping field which is used for toner cloud generation and has a typical potential of 2.6k volts peak to peak at 3.25k Hz frequency. The second field is the dc development field which is used to control the amount of developed toner mass on the photoreceptor.

In a development system as that described above dirt emissions generated by the developer housing are airborne toner particles that are no longer contained within the developer housing. These toner particles collect, and contaminate internal machine components and may potentially cause a fault or an unscheduled maintenance. In some instances toner emissions may develop onto areas on the photoreceptor as background or on the extreme inboard or outboard edges that can cause edge sensor faults if they become too dirty. Various approaches have been utilized in the past to reduce or eliminate dirt emissions. Expensive vacuum systems are the most effective way to deal with dirt emissions, however cost and available space are major factors when attempting to alleviate dirt emissions problems in some printing machines.

It is desirable to provide a device and/or method to minimize or eliminate dirt emissions emanating from toner leakage from a developer housing which is cost effective and relatively simple. It is further desirable that any such emission preventive device not have a negative impact on the function or life of the developer housing components.

In accordance with one aspect of the present invention, there is provided a noncontact seal device for a donor roll in an electrophotographic printing machine, comprising a developer housing, a donor roll rotatably mounted in said housing for transferring toner particles to a latent image on a photoreceptive member and a seal member, fixedly mounted to said housing, adjacent to and partially enveloping but not contacting a first end of said donor roll to prevent toner particles from being emitted past the first end of said donor roll.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
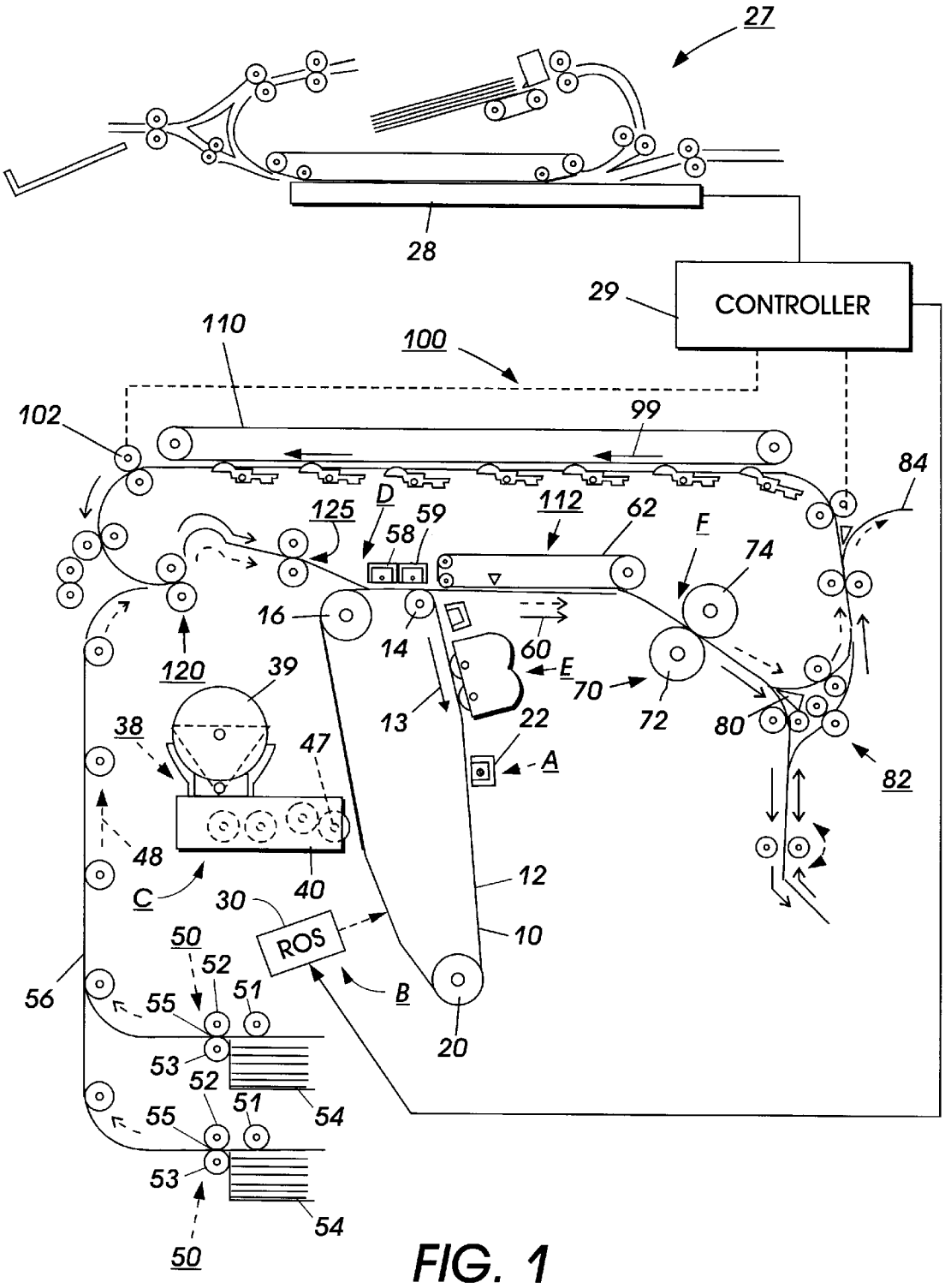
FIG. 1 is a schematic elevational view of a typical electrophotographic printing machine utilizing the seal device of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the noncontact seal of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a fuser release agent donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 99, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 99, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

The development system utilized herein is generally described as follows. A hybrid development system is used where toner is loaded onto a donor roll from a second roll (e.g. a magnetic brush roll).) The toner is developed onto the photoreceptor from the donor roll using the hybrid jumping development system. Toner is metered onto a donor roll and a toner cloud is formed in a development nip between the donor roll and the charge retentive surface having a latent electrostatic image thereon. The toner cloud is formed by applying an alternating potential to the donor roll so as to cause the toner particles to jump off of the donor roll. It is this cloud of toner particles that can cause contamination throughout the printing machine.

Air flow studies indicated that certain areas of the developer housing had negative air flow and other areas generated positive air flows. It was determined that the developer housing had several areas of positive air flow, one of which were the gap areas on the inboard and outboard ends of the donor roll between the ends of the donor roll and the developer housing wall. A device to effectively seal the gap while preventing excess wear or sub-standard performance of the developer donor roll was determined to be necessary.

Figure 2:
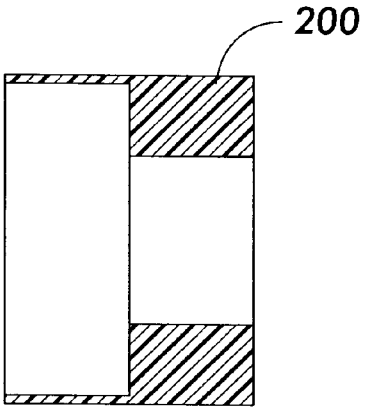
FIG. 2 is a side view of the donor roll emission seal of the present invention.

Turning to FIG. 2 there is illustrated a sectioned side view of the non-contact seal that was designed for the gap between the donor roll and the developer housing wall.

Figure 3:
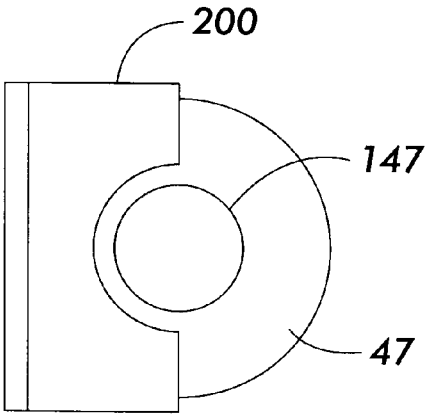
FIG. 3 is an end view of the seal showing the relationship with the donor roll.
Figure 4:
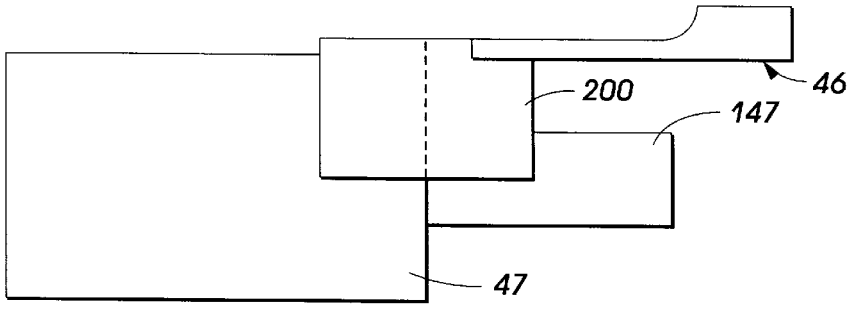
FIG. 4 is a partial schematic of the hybrid development system illustrating the installation of the developer seal in the developer housing.
Figure 5:
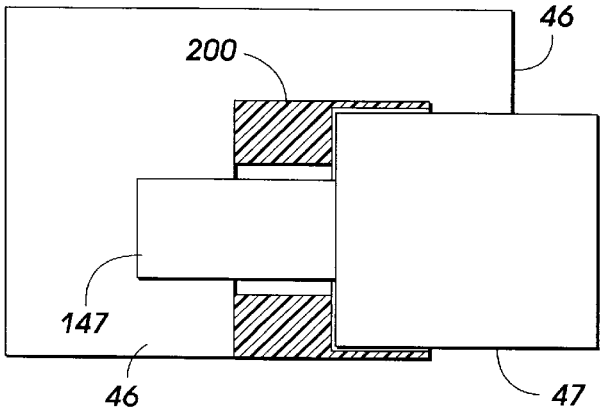
FIG. 5 is a side view illustrating the location of the seal in the developer housing.
Figure 6:
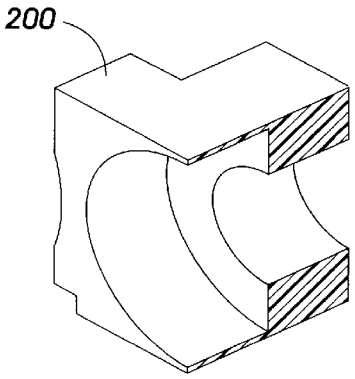
FIG. 6 is a perspective sectioned view of the developer housing donor roll seal.

FIG. 3 illustrates an end view of the seal demonstrating the relationship of the seal 200 and the donor roll 47. When the seal 200 is installed in the developer housing, as illustrated by the top view in FIG. 4 and the side view in FIG. 5 the gap between the ends of the donor roll 47, the donor roll shaft 147 and the developer housing wall 46 is closed. The seal is made of an acetol material such as DELRIN® and does not contact the ends of the donor roll but leaves a very small gap. The seal prevents positive airflow in the gap area which prevents dirt emissions. An added benefit of the seal is that toner buildup on the inboard and outboard edges of the donor roll is prevented thereby eliminating toner emissions on the edges of the photoreceptor.

In recapitulation, there is provided a noncontact seal for a donor roll in an electrophotographic printing machine. The seal is fixed in the developer housing and envelopes each end of the donor roll but does not contact the donor roll. The small space does not allow a positive airflow sufficient to cause toner particles to be emited from the developer housing so as to contaminate the other portions of the printing machine. The seal is made of a low friction material such as DELRIN® so that toner particles do not stick to the seal and cause a buildup that would be detrimental to the photoreceptive member.

It is, therefore, apparent that there has been provided in accordance with the present invention, a developer housing emission seal that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A noncontact seal device for a donor roll in an electrophotographic printing machine, comprising:

a developer housing;

a donor roll rotatably mounted in said housing for transferring toner particles to a latent image on a photoreceptive member;

a nonmagnetic seal member, fixedly mounted to said housing, adjacent to and partially enveloping but not contacting a first end of said donor roll to prevent toner particles from being emitted past the first end of said donor roll.

2. A device according to claim 1, further comprising a second nonmagnetic seal member, fixedly mounted to said housing, adjacent to and partially enveloping but not contacting a second end of said donor roll to prevent toner particles from being emitted past the second end of said donor roll.

3. A device according to claim 1, wherein said seal comprises a low friction material comprising acetol.

4. A device according to claim 2, wherein said second seal comprises a low friction material comprising acetol.

* * * * *